US009782804B1

(12) United States Patent
Hatle et al.

(10) Patent No.: US 9,782,804 B1
(45) Date of Patent: Oct. 10, 2017

(54) METHOD FOR PASSIVATING SUBSTRATE SURFACES

(71) Applicant: CORRLINE INTERNATIONAL, LLC, Houston, TX (US)

(72) Inventors: Loren L. Hatle, Humble, TX (US); James J. Knocke, Cleveland, TN (US)

(73) Assignee: TGS Solutions, LLC, Houston, TX (US)

( * ) Notice: Subject to any disclaimer, the term of this patent is extended or adjusted under 35 U.S.C. 154(b) by 819 days.

(21) Appl. No.: 14/057,817

(22) Filed: Oct. 18, 2013

Related U.S. Application Data

(63) Continuation-in-part of application No. 13/359,108, filed on Jan. 26, 2012, now abandoned.

(51) Int. Cl.
*B08B 3/04* (2006.01)
*B08B 3/08* (2006.01)
*B08B 3/00* (2006.01)

(52) U.S. Cl.
CPC *B08B 3/08* (2013.01); *B08B 3/00* (2013.01); *B08B 3/04* (2013.01)

(58) Field of Classification Search
CPC ..... B08B 3/04; B08B 3/00; B08B 3/08
See application file for complete search history.

(56) References Cited

U.S. PATENT DOCUMENTS 2,567,835 A * 9/1951 Alquist ..... B08B 3/08 134/2
3,460,989 A * 8/1969 Rusch ..... C02F 5/083 134/2
3,730,901 A * 5/1973 Knox ..... C23G 1/08 134/3
5,505,785 A * 4/1996 Ferrell ..... B08B 3/08 134/1
5,653,045 A * 8/1997 Ferrell ..... B08B 3/102 257/E21.228
6,620,457 B2 9/2003 Farmer et al.
8,080,502 B2 12/2011 Herdt et al.
8,318,188 B2 11/2012 Man et al.
9,193,943 B1 * 11/2015 Hatle ..... C11D 17/0008
2005/0045202 A1 * 3/2005 Huang ..... C11D 3/3947 430/5
2007/0068558 A1 * 3/2007 Papanu ..... H01L 21/67051 134/29
2009/0191471 A1 * 7/2009 Lee ..... C11D 3/3947 430/5
2011/0214697 A1 * 9/2011 Archer ..... H01L 21/02041 134/28
2012/0058614 A1 * 3/2012 Nguyen ..... H01L 21/0206 438/264
2014/0065757 A1 * 3/2014 Yi ..... H01L 21/02054 438/71
2014/0273501 A1 * 9/2014 Glodde ..... H01L 21/0276 438/753

FOREIGN PATENT DOCUMENTS

EP 0574858 A1 * 12/1993
WO WO2007/025305 A2 * 3/2007

OTHER PUBLICATIONS

G. E. Delory and E. J. King, A Sodium Carbonate-bicarbonate Buffer for Alkaline Phosphates, Biochem Journal, 1945, p. 245, vol. 39(3).
CorrLine International, Scanning Electron Microscope & Energy Dispersive X-Ray Spectrometer Analysis of Samples Cleaned with CorrX, 2012, pp. 1-25.

* cited by examiner

*Primary Examiner* — Bibi Carrillo
(74) *Attorney, Agent, or Firm* — Dileep Rao

(57) ABSTRACT

A method for passivating substrate surfaces by removing surface contaminants. The method can remove impurities and components from the surface of a substrate to prevent corrosion and undesirable chemical activity. The method further provides an optimized surface for the application of protective barrier coatings. The method provides significant cost savings due to increased life of substrate, reduced maintenance, and superior barrier coating performance.

9 Claims, No Drawings

METHOD FOR PASSIVATING SUBSTRATE SURFACES

CROSS REFERENCE TO RELATED APPLICATIONS

The current application is a Continuation in Part and claims the benefit of co-pending U.S. patent application Ser. No. 13/359,108 filed on Jan. 26, 2012, entitled "METHOD FOR PROVIDING IMPROVED ADHESION OF BARRIER COATINGS TO METALS now abandoned." This reference is hereby incorporated in its entirety.

FIELD

The present embodiments generally relate to a method for preparing and decontaminating a material surface to remove contaminants without leaving a chemical residue. The method removes water soluble, and water insoluble contaminants such as sulfur and chlorine compounds that can cause the degradation of material, corrosion, attract bacteria, decrease the efficacy of barrier coating adhesions, undesirable anodic/cathodic reactions, or undesirable chemical reactions.

The method further decontaminates a material surface without damaging the underlying material or leaving a chemical residue.

BACKGROUND

A need exists for a method to prepare surfaces of materials such as concrete and metals to remove contaminants and prevent degradation of both coatings and the underlying material through oxidation, or other chemical processes. The treatment of surfaces would have the added advantage of improved adhesion of barrier coatings. It would be greatly valuable to accomplish this goal while using components that are safe to use and environmentally friendly.

A further need exists for this method to be portable, easy to implement, and easy to transport while still being effective to improve reliability and life of the underlying material.

The present embodiments meet these needs.

DETAILED DESCRIPTION OF THE EMBODIMENTS

Before explaining the present methods in detail, it is to be understood that the methods are not limited to the particular embodiments and that they can be practiced or carried out in various ways.

The present embodiments generally relate to a method for decontaminating a surface using portable and environmentally friendly components that can be in powder or fluid form.

The method is used to treat the surface of a material (also referred to as substrate) to remove contaminants and undesirable components without damaging the underlying substrate. The surface can then be coated with a protective barrier to prevent moisture or environmental and atmospheric contaminants from coming into contact with the material. The treatment of the surface allows coatings to adhere more tightly. Further, the treated surface improves welds by increasing weld puddle integrity and decreasing weld puddle porosity.

The method alone is sufficient to reduce substrate degradation due to contaminants. Especially in industrial applications, it is often desirable to coat the substrate with paints, epoxies, films, or other protective barriers. The present invention facilitates the effective coating of materials. It is often desirable to prepare a surface prior to welding. The present invention facilitates the preparation of surfaces and effective welding of materials.

It is important for coatings or barriers to adhere as tightly as possible to a surface, in order to increase the time it takes moisture or atmospheric contaminants to reach the substrate through penetration of the coating or barrier. It is believed by persons ordinarily skilled in the art that most substrate corrosion or coating failures are a result of improper substrate preparation.

In industry, surface preparation often includes blasting or scraping mechanisms, such as sand blasting, to remove mill scale or scale buildup, smooth the surface, and remove contaminants. The present method can be used in conjunction with these mechanical means to prepare a surface.

For example, contaminants left on a metal surface can cause coating disbondment and allow for the oxidation of the metal over time leading to rusting. Similarly, other construction materials can degrade due to chemical reactions involving the contaminants. Therefore, surface preparation is important for metals, concrete, and other materials of construction.

Proper surface preparation must address complete removal of both water-soluble and non-water-soluble contaminants, including salts, thereby achieving a surface molecular oxidation state of zero for any metal components of the surface (prior to rinsing as discussed below). Proper surface preparation would prevent contaminants being trapped underneath a coating, thereby allowing the substrate to be damaged even after a protective coating is applied.

The method can be utilized on a variety of industrial equipment and equipment components, such as items used in pipelines, bridges, ships, automobiles, chemical plants, refining plants, manufacturing plants, residential housing, commercial buildings, etc.

The primary benefit is increased substrate life due to decreased degradation of the substrate. This reduces costs by decreasing maintenance frequency, improving equipment availability, and reducing capital expenditures due to extended equipment and coating lifespans. It further promotes safety by maintaining the integrity of equipment components and preventing unpredicted failures.

The method further reduces maintenance costs by reducing the amount of time required to prepare surfaces for coatings, and virtually eliminating the wait time between preparation and application of coating.

The method can be applied to surfaces with mill scale or scale build up, or utilized after preparing a surface by blasting to remove scale. The unique combination of ingredients and steps make the method much more effective than current means. The method can be applied with low pressure equipment, less water, in less time, and with a lower cost than currently utilized means.

The cost savings, although variable by substrate and specific application, is significant and quantifiable. For example, industrial equipment can have a significant savings over its lifespan due to decreased maintenance and repairs due to the application of this method. Further, the equipment can have reduced downtime due to decreased preparation time for applying coatings, and longer life of coatings due to improved bonding.

The method also can be implemented in a safe and environmentally friendly manner. The components are significantly less harmful to persons using them than those used by other methods. Further, the components can be formulated such that the process effluents have little to no impact on the environment or groundwater supplies.

The components in the examples below will not negatively impact the environment, will not burn the skin, and will not affect groundwater supplies. Further, the components utilized in the method are safe to ship, either in powder form, or a pre-prepared fluid.

The method relates to utilizing a unique combination of components in a series of steps to treat a substrate to remove contaminants and create a chemically non-reactive surface. Several variations of the primary method are discussed below.

The method serves to completely cover a surface to allow dissolution, reaction, or dispersion of contaminants from the surface. The method is highly effective in removing sulfides, sulfur compounds, chlorides, and chlorine compounds. These contaminants are known in the industry to be problematic to remove from substrate surfaces.

In embodiments, the method can also remove microbes, biomass, biofilm, dirt, oil, scale, water-soluble materials, water insoluble materials, mill scale, oxidation, and processing chemicals to create a passivated surface.

In industry, passivation refers to making a surface passive, such that it is less reactive to atmospheric gasses, moisture, and contaminants. The present invention helps to passivate the material through highly effective removal of contaminants and subsequent surface pH adjustment. This results in greatly reduced, or no anodic/cathodic activity or oxidation activity on the surface due to contamination.

Removal of these reactive contaminants results in greatly decreased corrosion, greatly reduced anodic/cathodic surface activity, and greatly reduced bacterial content (for example of sulfur reducing bacteria).

The present invention provides for passivating a mild steel surface in a simple and cost effective manner, which is previously unknown in industry.

Generally, the method and its variations make use of three components.

The first component comprises an acidifier to create a low pH solution. The first component can be in powder form, fluid form, or powder mixed with a liquid to create a solution. Alternatively, the first component can be a liquid or gel comprising the necessary elements. In other embodiments, it may be optimal to apply the first component in powder form. In most cases, the application of the first component will be in liquid form, as illustrated by the examples below.

The acidifier comprises an acid and an oxidizer. There are numerous organic and mineral acids that serve to create a solution of low pH. A pH of less than 4 is desired. Optimally, a pH less than 2 is desired for decontamination of hard metals and aggregate materials.

Acids that can be a component of the acidifier include, but are not limited to: organic acids, mineral acids, partial salts of organic acids, partial salts of mineral acids, and combinations thereof. The examples below make use of citric acid and sodium bisulfate, which is desirable due to its low toxicity level, low cost, ease of acquisition, and favorable reactivity characteristics.

Some examples of mineral acids are: Hydrochloric acid, Nitric acid, Phosphoric acid, Sulfuric acid, Boric acid, Hydrofluoric acid, Hydrobromic acid, and Perchloric acid. Organic acids usable are numerous and an exhaustive listing is impractical. The organic acids can be short and medium chain organic acids. The method can make use of any acid that can generate the desired pH value. However, food grade acids are preferred due to their lower environmental impact.

Oxidizers that can be used include, but are not limited to organic peroxides, inorganic peroxides, peracids, peresters, and combinations thereof.

Commonly used oxidizers include persulfates, perborates, percarbonates, and combinations thereof. The examples below make use of Sodium persulfate, which is desirable due to its stability, cost and low environmental impact.

Optionally, the first component can include a rheology modifier. The rheology modifier can be in powder form, fluid form, or powder mixed with a liquid to create a solution. The rheology modifier acts to thicken the first component to provide better coverage of surfaces. The rheology modifier can be used to increase cling characteristics of the first component to provide complete coverage of a surface. In addition, the rheology modifier helps to create an oxygen barrier between the atmosphere and the surface. This aids in the efficacy of the method as seen in the examples below.

Rheology modifiers that can be used include, but are not limited to xanthan gum, guar gum, smectite clay, organic polymer thickeners, silica based thickeners, and combinations thereof. The examples below make use of xanthan gum, which is desirable due to its ease of solubility, biodegradability, safety, and low environmental impact.

Optionally, the first component can include a surface tension reducer. The surface tension reducer can be in powder form, liquid form, or powder mixed with a liquid to create a solution. The surface tension reducer acts to provide desirable flow characteristics to the first component. It allows the first component to better cover a surface and enter any cavities or non-uniform portions of a surface.

Surface tension reducers that can be used include, but are not limited to industrial surfactants, fluoroalkyls, non-ionic silicone polyethers, sodium polyphosphate, a soap, a non-ionic alkyne, or combinations thereof. The examples below make use of silicone polyether.

Surface tension reducers are chosen to help fully wet the surface of the substrate with minimal foaming action. In embodiments, a stronger detergent in combination with the first component can be used to achieve a dual function of oil removal and surface preparation. Surface tension reducers can be anionic, nonionic, cationic amphoteric, or amine oxide surfactants.

Persons ordinarily skilled in the art would be able to formulate a surface tension reducer using many well-known surfactant products, or combinations thereof.

The second component comprises a pH modifier. The pH modifier can be in powder form, fluid form, or powder mixed with a liquid to create a solution. The pH modifier acts to bring the pH of the surface being treated above 7 when combined with the first component. A desirable pH level of the pH modifier is above 8.5.

The second component optionally can include a rheology modifier. The rheology modifier can be in powder form, fluid form, or powder mixed with a liquid to create a solution. The rheology modifier serves the same purpose as that described in the first component, but need not be the same element or compound.

The third component comprises an alkaline material, and can be a fugitive alkaline material. The purpose of this component is to rinse away the first and/or second components. Usage of the third component creates an alkaline layer upon the substrate. During drying, the third component evaporates and leaves the surface with a generally neutral pH. By utilizing a fugitive material, there is no chemical residue left upon the substrate surface upon drying.

In this manner, the third component serves to "finish" the surface by creating a clean and neutral surface that, upon drying, will greatly reduce the chance or extent of flash rusting. Further, the substrate is less subject to undesirable chemical reactions due to contaminants.

Rinsing a metal with the third component does not yield a bare steel surface, but one with a coating. This coating is an oxidized form of iron, such as iron carbonate, that protects the surface from forming undesirable oxides when exposed to air or water. The coating is not a residue, but a desired result to passivate the surface. This is the first industrially practical method that can be applied to passivate mild steel.

Purified water can be used to combine with any of the first, second, or third component to create a liquid solution or to dilute solutions to achieve desired concentrations by persons ordinarily skilled in the art. Purified water can also be used as a rinse in this method.

Purified water can refer to water with a low level of conductivity (less than 200 micro-mhos, preferably less than 20 micro-mhos), deionized water, water produced by reverse osmosis, distilled water, deionized water, water with a pH from 5 to 9 (inclusive), or combinations thereof.

In one embodiment, the first component is applied to a substrate surface. The application can be accomplished in many ways. In the instance that the first component is in powder form, it can be sprayed or sprinkled on the surface. The powder can be mixed with purified water to create a fluid (or can be supplied as a fluid) and applied by any known method of applying liquids which include, but are not limited to: electrostatic means, brush, roller, conventional pressure washer, air assisted application equipment, wet abrasive blast equipment, airless sprayer, conventional sprayer, garden sprayer, or spray bottle.

In order to get more thorough coating of the first component, the surface can be vibrated using various techniques known to persons ordinarily skilled in the art. For example, pneumatic, ultrasound, or mechanical methods can be used.

The first component is then allowed a dwell time on the surface of the substrate. The dwell time allows the constituents of the first component to react with contaminants on the surface of the substrate. In addition to the other contaminants discussed above, typical chemical contaminants on metal and concrete surfaces include, but are not limited to chlorine compounds, oxygen compounds, nitrogen compounds, and sulfur compounds.

The dwell time can be adjusted by persons ordinarily skilled in the art to account for various factors which include, but are not limited to substrate composition, contaminant level, specific constituents used in the first component, volume of the first component used, atmospheric pressure, and temperature.

A typical dwell time for metal can range from fifteen minutes to an hour at ambient temperature, but also can vary greatly depending on the situation. A typical dwell time for concrete can range from fifteen minutes to an hour at ambient temperature, but also can vary greatly depending on the situation.

Upon completion of the dwell time, the substrate is rinsed with the third component, purified water, or a combination thereof. Selection of the rinse is dependent upon a variety of factors. For example, purified water is a desirable rinse when a salt-free surface is desired. The third component is desirable to create a modified surface that greatly retards flash rusting and has superior acceptance for coatings.

In some embodiments, prior to rinsing the substrate, the steps of applying the first component and allowing a dwell time are repeated.

In some embodiments, prior to rinsing the substrate, the steps of applying the second component and allowing a dwell time for the second component are added.

When a rheology modifier is used as an optional constituent, the first component further serves as a barrier between the substrate and the atmosphere. This prevents the exposure of the acidified substrate surface to the moisture, oxygen or other atmospheric gasses, or air contaminants, thus preventing undesired reactions. For example a metal substrate would not react with oxygen to form metal oxides, or rust.

The rheology modifier further aids in creating improved adhesion of the first component to vertical surfaces ("vertical cling.") This acts to prevent flash rust or recontamination of the surface.

In some embodiments, the first component can be allowed to dry and left upon the substrate for a period of time until a second application of the first component, followed by a rinse.

In one or more embodiments, mechanical action, such as scrubbing, vibration, etc., can be incorporated in the methods to reduce the time and/or/chemical and/or pressure to remove surface contaminants.

In one or more embodiments, drying of a surface can be accelerated by heating, forced air circulation, or other methods known to persons ordinarily skilled in the art.

In some cases, for example when the surface of the substrate is oddly shaped, it may be desirable to submerge the substrate in a bath as opposed to applying the components.

In embodiments, the substrate can be submerged in an ambient or heated bath of the components and allowed a soak time as an alternative to applying the components and allowing a dwell time. Soaking the substrate in a bath has the added benefits of no exposure to atmospheric components, better coverage of the substrate with components, and increased ability to control component temperatures.

In embodiments that a bath is used, the fluid in the bath can be agitated by mechanical means, ultrasound, or vibration. The mechanical means can include a recirculation of fluid through stirring, or the use of fluid nozzles. Ultrasound can be applied to the bath, or to the object to agitate the bath. Further, vibration mechanisms can help to loosen contaminants in the bath.

The examples below serve to illustrate various uses of the methods claimed.

Example A

A solution is mixed wherein the first component comprises 10.7315% of a buffered acid system comprising citric acid and sodium bisulfate, (10.4394% Citric acid and 0.2921% Sodium bisulfate). The first component further comprises 0.4986% of Sodium persulfate (oxidizer), 1.4986% Xanthan Gum (rheology modifier), and 0.0127% of silicone polyether (surface tension reducer). The solution is sprayed on a mild steel surface with a conventional paint sprayer. A dwell time of 30-60 minutes is allowed. The steel is then rinsed with the third component comprising 0.1815% Dimethylethanolamine to achieve a passivated surface.

Example B

A solution is mixed wherein the first component comprises 10.7315% of a buffered acid system consisting of citric acid and sodium (10.4394% Citric acid and 0.2921% Sodium bisulfate). The first component further comprises 0.4986% of Sodium persulfate (oxidizer), and 1.4986%

Xanthan Gum (rheology modifier). The solution is sprayed on a metal surface (steel, iron, copper, etc.) with an airless paint sprayer. A dwell time of 30-60 minutes is allowed. The solution is re-sprayed over the initial application of the first component with a conventional or airless paint sprayer. A dwell time of 30-60 minutes is again allowed. The metal is then rinsed with the third component comprising 0.1815% Dimethylethanolamine to achieve a passivated surface.

Example C

A solution is mixed wherein the first component comprises 10.7315% of a buffered acid system comprising citric acid and sodium bisulfate, (10.4394% Citric acid and 0.2921% Sodium bisulfate). The first component further comprises 0.4572% of Sodium persulfate (oxidizer), and 1.4986% Xanthan Gum (rheology modifier). The solution is sprayed on a concrete surface with a conventional paint sprayer. A dwell time of 30-60 minutes is allowed for the first component. A solution is mixed wherein the second component comprises 8% of a blend of Sodium bicarbonate and Sodium carbonate (pH neutralizer) and 1% of carboxymethyl cellulose (rheology modifier) in water. A dwell time of 15-60 minutes is allowed for the second component. The concrete is then rinsed with purified water. A protective coat of sealant, epoxy, paint, or other coatings can be applied.

Example D

A solution is mixed wherein the first component comprises 10.7315% of a buffered acid system comprising citric acid and sodium bisulfate, (10.4394% Citric acid and 0.2921% Sodium bisulfate). The first component further comprises 0.4572% of Sodium persulfate (oxidizer), and 1.4986% Xanthan Gum (rheology modifier). The solution is sprayed on a concrete surface with a conventional paint sprayer. A solution is mixed wherein the second component comprises 8% of a blend of Sodium bicarbonate and Sodium carbonate (pH neutralizer) and 1% of carboxymethyl cellulose (rheology modifier) in water. A dwell time of 15-60 minutes is allowed for the second component. The concrete is then rinsed with the third component comprising 0.1815% of Diethanolamine.

Example E

Soaking an object in a bath comprised of the first component wherein the first component comprises 0.228% of Citric acid, 0.144% Sodium bisulfate, and 0.228% of Sodium persulfate (oxidizer) in water. Fluid is agitated using mechanical, ultrasound, or vibration methods. A soak time of 30-60 minutes is allowed. The object is removed to a second bath comprising the second component comprising 8% of a blend of Sodium bicarbonate and Sodium carbonate (pH neutralizer). A soak time of 30-60 minutes is allowed. The object is removed from the second bath and rinsed with purified water.

While these embodiments have been described, it should be understood that within the scope of the appended claims, the embodiments might be practiced other than as specifically described herein.

What is claimed is:

1. A method for removing surface contaminants without leaving a chemical residue, comprising the steps of:

a) providing an acidifier solution having a pH of less than 4 comprising the following constituents:
   i) an acid;
   ii) an oxidizer;
   iii) purified water
   iv) optionally a first rheology modifier comprising:
      (a) xanthan gum;
      (b) guar gum;
      (c) smectite clay;
      (d) organic polymer thickeners;
      (e) silica based synthetic thickeners; or
      (f) combinations thereof;
   v) optionally a surface tension reducer comprising:
      (a) nonionic surfactants;
      (b) anionic surfactants;
      (c) cationic surfactants;
      (d) amphoteric surfactants;
      (e) amine oxides;
      (f) non-ionic silicone polyethers; or
      (g) combinations thereof;
b) providing a first aqueous alkaline solution having a pH greater than 8 comprising:
   i) a pH modifier comprising:
      (a) a hydroxide of an alkali metal;
      (b) a hydroxide of an alkaline earth metal;
      (c) amines;
      (d) carbonates; or
      (e) combinations thereof;
   (ii) purified water;
   (iii) optionally a second rheology modifier comprising:
      (a) xanthan gum;
      (b) guar gum;
      (c) smectite clay;
      (d) organic polymer thickeners;
      (e) silica based synthetic thickeners; or
      (f) combinations thereof;
c) providing a second aqueous alkaline solution comprising purified water and dimethylethanolamine, wherein said second aqueous alkaline solution has a pH of greater than 8 and said second aqueous alkaline solution is different from the first aqueous alkaline solution;
d) applying the acidifier solution to the surface of the substrate for a first dwell time;
e) applying the first aqueous alkaline solution to the surface of the substrate for a second dwell time after performing step d); and
f) rinsing the surface by applying the second aqueous alkaline solution comprising purified water and dimethylethanolamine to the surface of the substrate to remove surface contaminants from the surface of the substrate.

2. The method of claim 1, prior to rinsing the surface further comprising:

a) re-applying the acidifier solution to the surface of the substrate after the first dwell time; and
b) allowing a third dwell time for the re-applied acidifier solution.

3. The method of claim 1, wherein the acid comprises:

a a mineral acid;
b an organic acid;
c a salt of a mineral acid;
d a salt of an organic acid; or
e combinations thereof.

4. The method of claim 1, wherein the acidifier solution further comprises the first rheology modifier.

5. The method of claim 1, wherein the oxidizer comprises:

a a persulfate;
b a perborate;
c a percarbonate;

d a peroxide; or e combinations thereof.

6. The method of claim 1, wherein the acidifier solution further comprises the surface tension reducer, wherein the surface tension reducer comprises the non-ionic silicone polyether.

7. The method of claim 1, wherein the purified water comprises:

a) water having a conductivity of less than 200 micromhos;

b) deionized water;

c) reverse osmosis produced water;

d) distilled water; or e) combinations thereof.

8. The method of claim 1, wherein applying each of the solutions is accomplished by:

a) a sprayer;

b) a brush;

c) a roller; or d) a wet abrasive blast equipment.

9. The method of claim 1, wherein the surface is steel and the surface is passivated.

* * * * *